US010326194B2

(12) United States Patent
Sharp et al.

(10) Patent No.: US 10,326,194 B2
(45) Date of Patent: Jun. 18, 2019

(54) ANTENNA MOUNT FOR ELECTRICAL PANEL BOARDS

(71) Applicant: SCHNEIDER ELECTRIC USA, INC., Schaumburg, IL (US)

(72) Inventors: Jeffrey O. Sharp, Murfreesboro, TN (US); Arthur J. Blake, Jr., Leominster, MA (US); Joseph E. House, Cedar Rapids, IA (US)

(73) Assignee: SCHNEIDER ELECTRIC USA, INC., Andover, MA (US)

( * ) Notice: Subject to any disclaimer, the term of this patent is extended or adjusted under 35 U.S.C. 154(b) by 364 days.

(21) Appl. No.: 15/101,455

(22) PCT Filed: Dec. 12, 2013

(86) PCT No.: PCT/US2013/074595

§ 371 (c)(1),
(2) Date: Jun. 3, 2016

(87) PCT Pub. No.: WO2015/088532

PCT Pub. Date: Jun. 18, 2015

(65) Prior Publication Data

US 2016/0308267 A1 Oct. 20, 2016

(51) Int. Cl.

| | |
|---|---|
| ***H01Q 1/12*** | (2006.01) |
| ***H01Q 1/22*** | (2006.01) |
| ***H01Q 1/50*** | (2006.01) |

(52) U.S. Cl.
CPC ..... *H01Q 1/1214* (2013.01); *H01Q 1/2233* (2013.01); *H01Q 1/50* (2013.01)

(58) Field of Classification Search
CPC ..... H01Q 1/1214; H01Q 1/2233; H01Q 1/50
USPC ..... 343/878, 872
See application file for complete search history.

(56) References Cited

U.S. PATENT DOCUMENTS

| | | | | |
|---|---|---|---|---|
| 3,115,308 A | | 12/1963 | Stark | |
| 3,434,137 A | | 3/1969 | Rueger | |
| 4,086,483 A | * | 4/1978 | Freund | B60Q 3/14 174/153 G |

(Continued)

FOREIGN PATENT DOCUMENTS

EP 0 647 997 B1 5/1997

OTHER PUBLICATIONS

International Search Report and Written Opinion dated Mar. 19, 2014 in PCT/US2013/074595, 15 pp.

*Primary Examiner* — Khai M Nguyen
(74) *Attorney, Agent, or Firm* — Locke Lord LLP

(57) ABSTRACT

An antenna mount (120, 220) is provided for an enclosure (100) of a panelboard. The mount includes an antenna cover (130, 230) mountable on the enclosure via a hole on a wall of the enclosure. The cover includes an opening (146, 246) at one end to receive an antenna in the cover and a mounting assembly (140 and 150, 240 and 250) to mount the one end onto the enclosure via the hole. The mounting assembly includes a flange (140, 240) which abuts against or is proximate the wall of the enclosure around the hole when the cover is arranged in the hole at a mounted position. The mount also includes a retainer (170, 270) which engages the opposite end of the cover to close the opening and retain the antenna in the cover. The mounting assembly can be a snap-in mounting assembly or a screw-on mounting assembly.

19 Claims, 8 Drawing Sheets

(56) References Cited

U.S. PATENT DOCUMENTS

| | | | | |
|---|---|---|---|---|
| 6,083,040 | A | 4/2000 | Mosquera | |
| 7,339,482 | B2 | 3/2008 | Jaeger et al. | |
| 7,595,763 | B2 * | 9/2009 | Hershey | H01Q 1/42 343/757 |
| 8,543,225 | B2 * | 9/2013 | Parker | G05B 15/02 307/104 |
| 8,766,799 | B2 * | 7/2014 | Gray | H04B 1/3888 340/539.1 |
| 2010/0117924 | A1 * | 5/2010 | Provenzano | H01Q 1/1214 343/878 |

* cited by examiner

ANTENNA MOUNT FOR ELECTRICAL PANEL BOARDS

FIELD

The present disclosure relates to the field of electrical enclosures, and more particularly, to an antenna mount for use with an electrical enclosure for an electrical panel.

BACKGROUND

Power management systems for residential or other facilities may employ wireless communication modules or equipment to communicate energy measurements or parameters monitored at various locations, such as at a load center, which is a panelboard for residential applications. A wireless communication module can include a radio antenna and radio circuitry, which are provided at each monitored location. When monitoring an electrical panel such as a panelboard, the electrical enclosure of the panelboard may interfere with radio signal transmission if the antenna is arranged in the enclosure. Moreover, the radio signal transmission may interfere with fault detection and other circuitry if the antenna is positioned inside the enclosure. However, if the radio antenna is positioned externally such as through a hole in the enclosure, the integrity of the enclosure is compromised by the hole created for the radio antenna and may not satisfy industry standards, such as UL mechanical, electrical and flammability requirements. In addition, there is a possibility that the radio antenna may pose a potential shock hazard to a user if the insulation for the antenna's electrical cable becomes compromised and line voltage electrical power is transmitted to the antenna.

SUMMARY

To address these and other shortcomings, there is disclosed an antenna mount for an enclosure of an electrical panel, such as a panelboard. The antenna mount includes an antenna cover (also referred to as "antenna shield" or "antenna housing") which is mountable on the enclosure via a hole on a wall of the enclosure. The antenna cover includes an opening at one end through which to insert an antenna into the antenna cover, and a mounting assembly to mount the one end of the antenna cover onto the enclosure via the hole. The mounting assembly includes at least a flange which is configured to abut against or to be adjacent (e.g., in contact, near or in proximity) the wall of the enclosure around the hole when the antenna cover is arranged in the hole at a mounted position. The antenna mount also includes a retainer configured to engage the antenna cover to close the opening and retain the antenna in the antenna cover.

The disclosed antenna mount can be mounted onto an enclosure of an electrical panel, such as a panelboard, from the inside of the enclosure through a hole in the enclosure. Accordingly, the disclosed antenna mount can take advantage of an unused knock out (KO) on the enclosure and can be easily retrofitted onto existing electrical enclosures, even where the panelboard is recessed into a finished wall where an installer does not have access to the outside of the panelboard. The disclosed antenna mount also allows a radio antenna to extend out from the enclosure, and to provide a protective barrier around the antenna to prevent physical damage to the antenna and contact by a user. The disclosed antenna mount can also be formed from a dielectric material, plastic or other suitable materials to satisfy UL mechanical, electrical and flammability requirements.

In one embodiment, the mounting assembly is a snap-in mounting assembly. In this example, the mounting assembly also includes one or more flexible flaring arms that are arranged adjacent to the flange of the antenna cover. Each flexible flaring arm is configured to deflect to allow passage through the hole as the antenna cover is inserted through the hole and to expand and snap outward as a portion of the flexible flaring arm exits the hole to apply a clamping force together with the flange to retain the antenna cover on the enclosure at the mounted position.

In another embodiment, the mounting assembly is a screw-on mounting assembly. In this example, the mounting assembly further includes a threaded portion adjacent to the flange on the antenna cover. The antenna cover can be inserted and screwed into the hole at the threaded portion until the flange abuts or is adjacent the interior wall around the hole at the mounted position. Furthermore, the end of the antenna cover with the mounting assembly may include two flexible cantilever legs that are configured to engage the retainer. The retainer may take the form of a vinyl cap or boot.

BRIEF DESCRIPTION OF THE DRAWINGS

The description of the various exemplary embodiments is explained in conjunction with the appended drawings, in which.

DETAILED DESCRIPTION

Antenna mounts are disclosed for an electrical enclosure of an electrical panel, such as a panelboard. An antenna mount is mounted onto the electrical enclosure and provides a protective housing for an antenna of a wireless communication module or system, such as for example one which is used to communicate conditions or sensed parameters of the electrical panel, control signals or other data in a power management system.

Figure 1A:
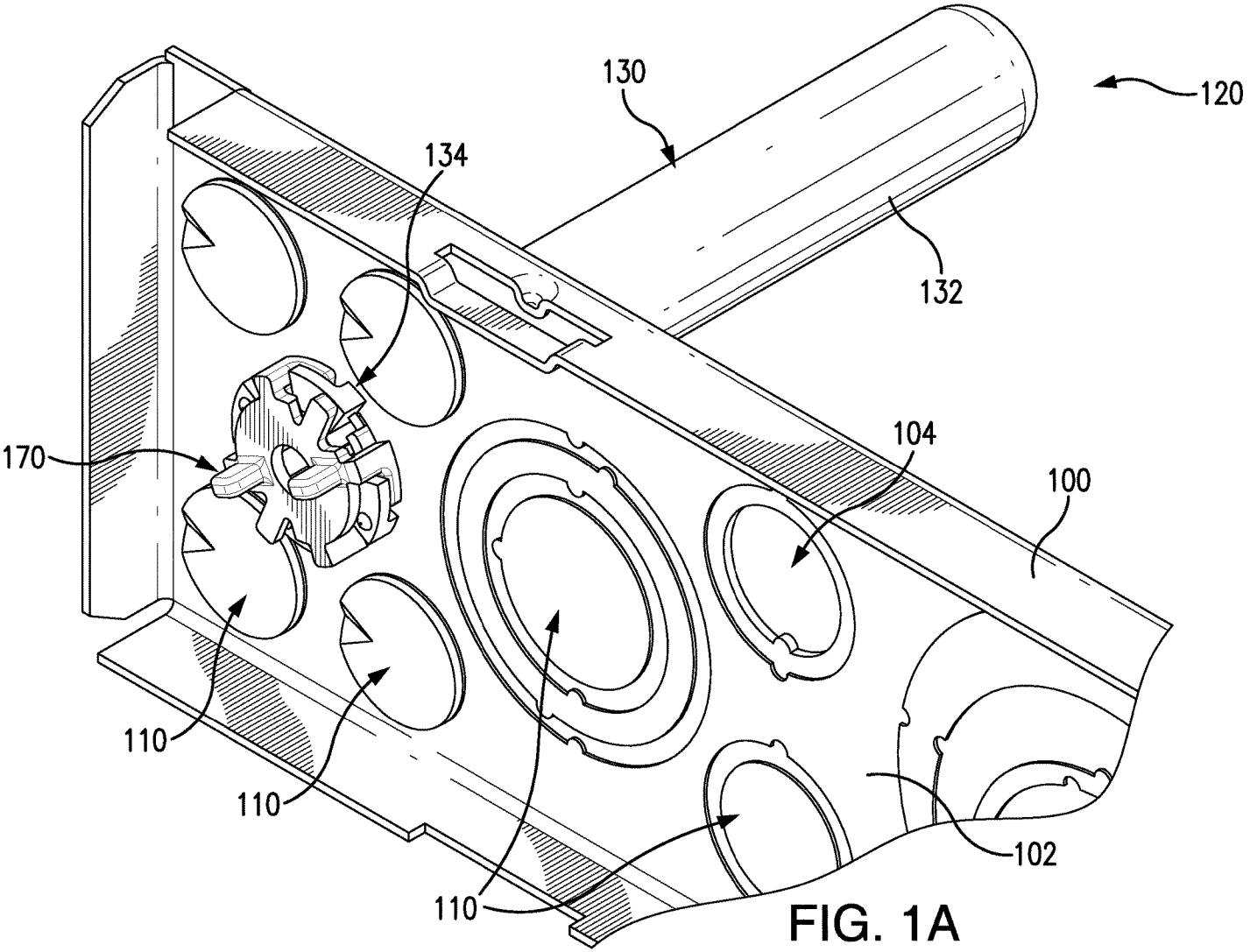
FIG. 1A illustrates an antenna mount mounted onto a wall of an enclosure for an electrical panel, in accordance with a first embodiment of the present disclosure.
Figure 1B:
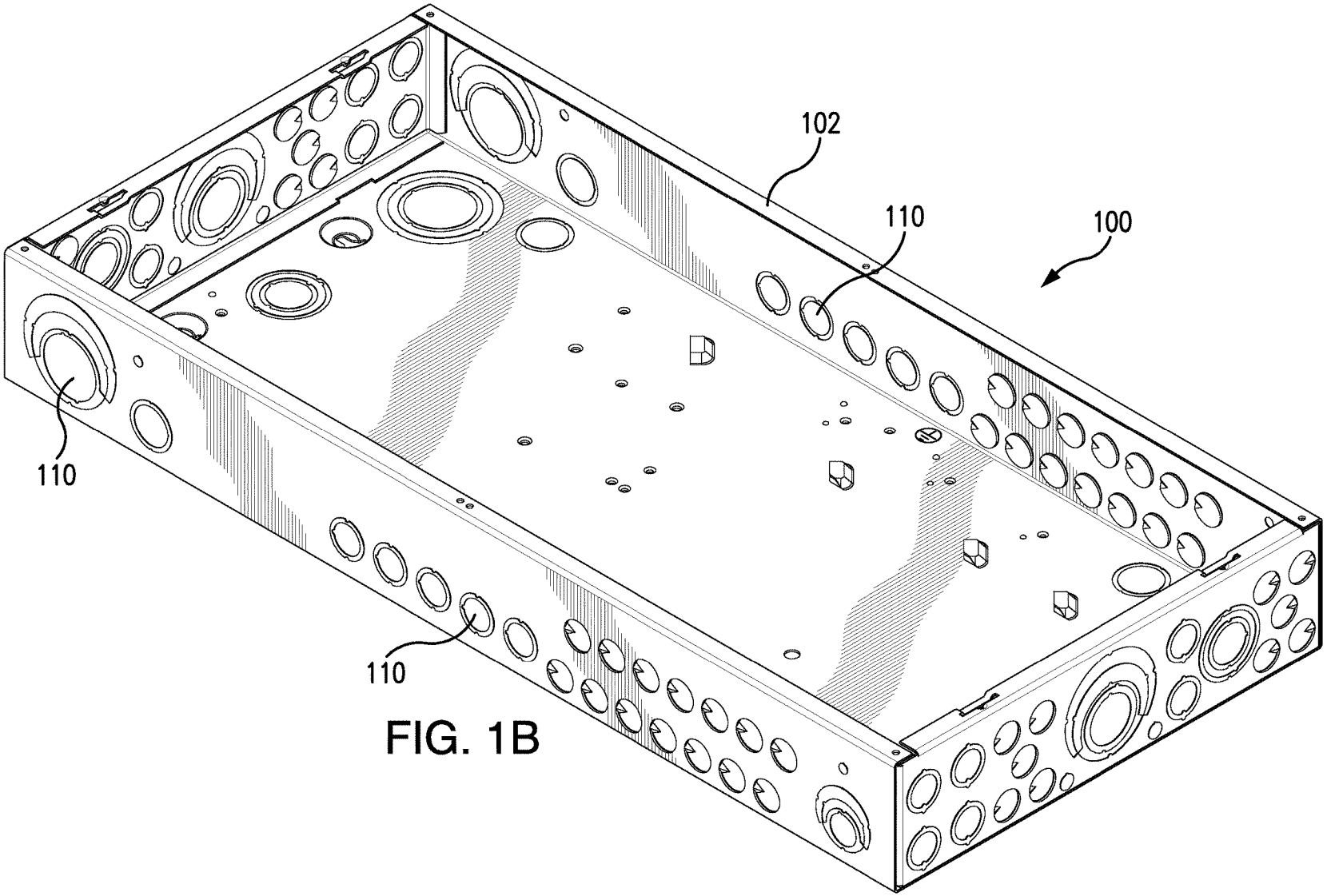
FIG. 1B illustrates another view of the enclosure of FIG. 1A.

FIG. 1A illustrates an antenna mount 120, which is mountable onto a wall 102 of an electrical enclosure 100, such as for an electrical panel, in accordance with a first embodiment of the present disclosure. The wall 102 may have a plurality of holes 104 and/or knock outs (KOs) 110, such as single or double KOs. The knock outs are pre-weakened portions of the wall 102, which can be removed to provide a hole, such as the holes 104, of varying sizes and shapes. The antenna mount 120 includes an antenna cover 130 and a retainer 170. The antenna cover 130 includes first end portion 132 and second end portion 134 opposite the first end portion 132. The first end portion 132 (also referred to as an "insertion end") is configured to be inserted through one of the holes 104 from an interior to an exterior of the enclosure to mount the antenna cover 130 onto the wall 102 of the electrical enclosure 100. For example, the antenna cover 130 has a size and shape (e.g., a diameter) which allow the antenna cover to be inserted through one of the holes 104. The second end portion 134 of the antenna cover 130 is mountable onto the wall 102 of the electrical enclosure 100, via one of the holes 104, on the wall 102. An example of the electrical enclosure 100 is shown in FIG. 1B.

Figure 2:
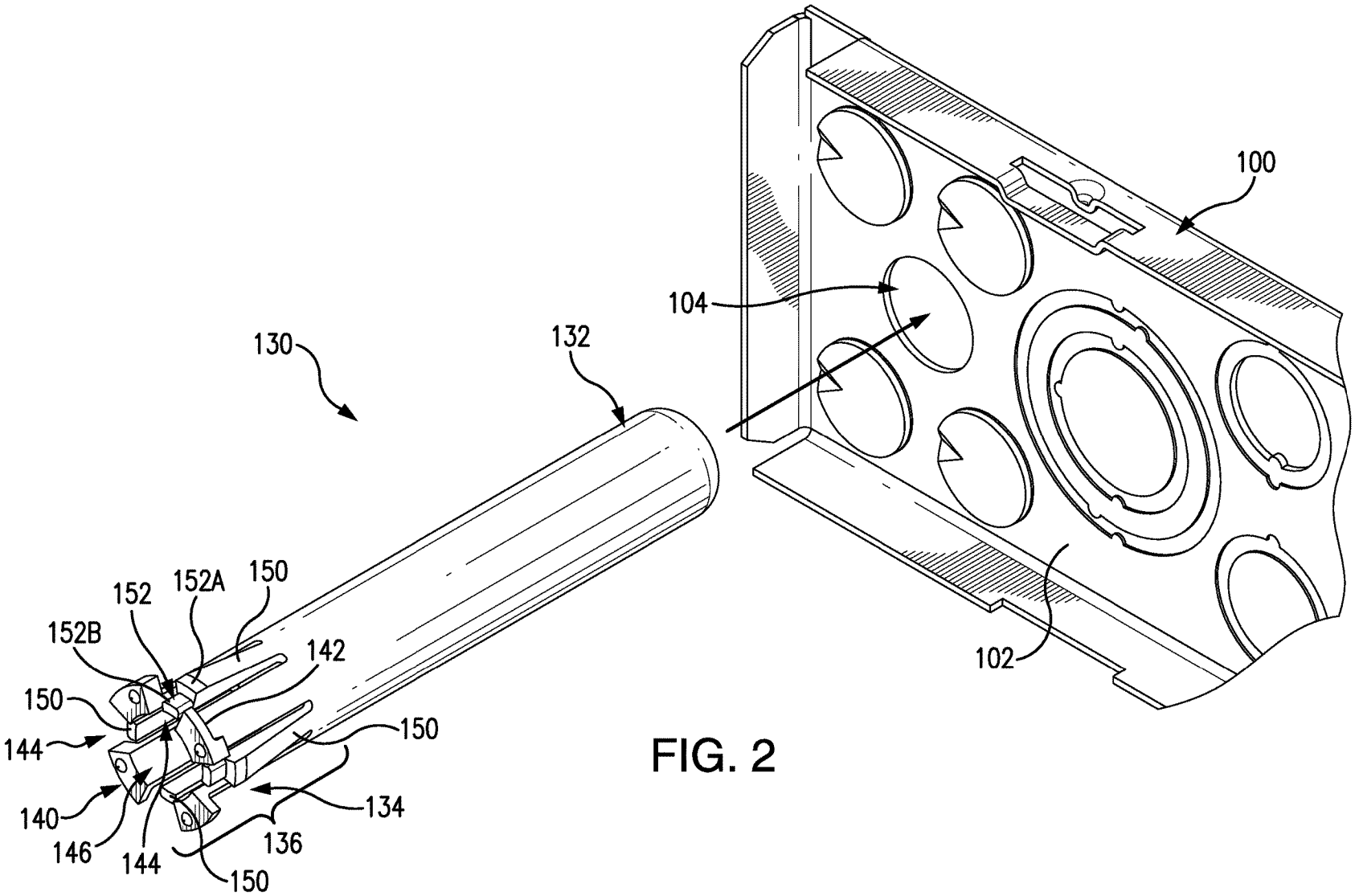
FIG. 2 illustrates a view of an antenna cover of the antenna mount of FIG. 1A.
Figure 3:
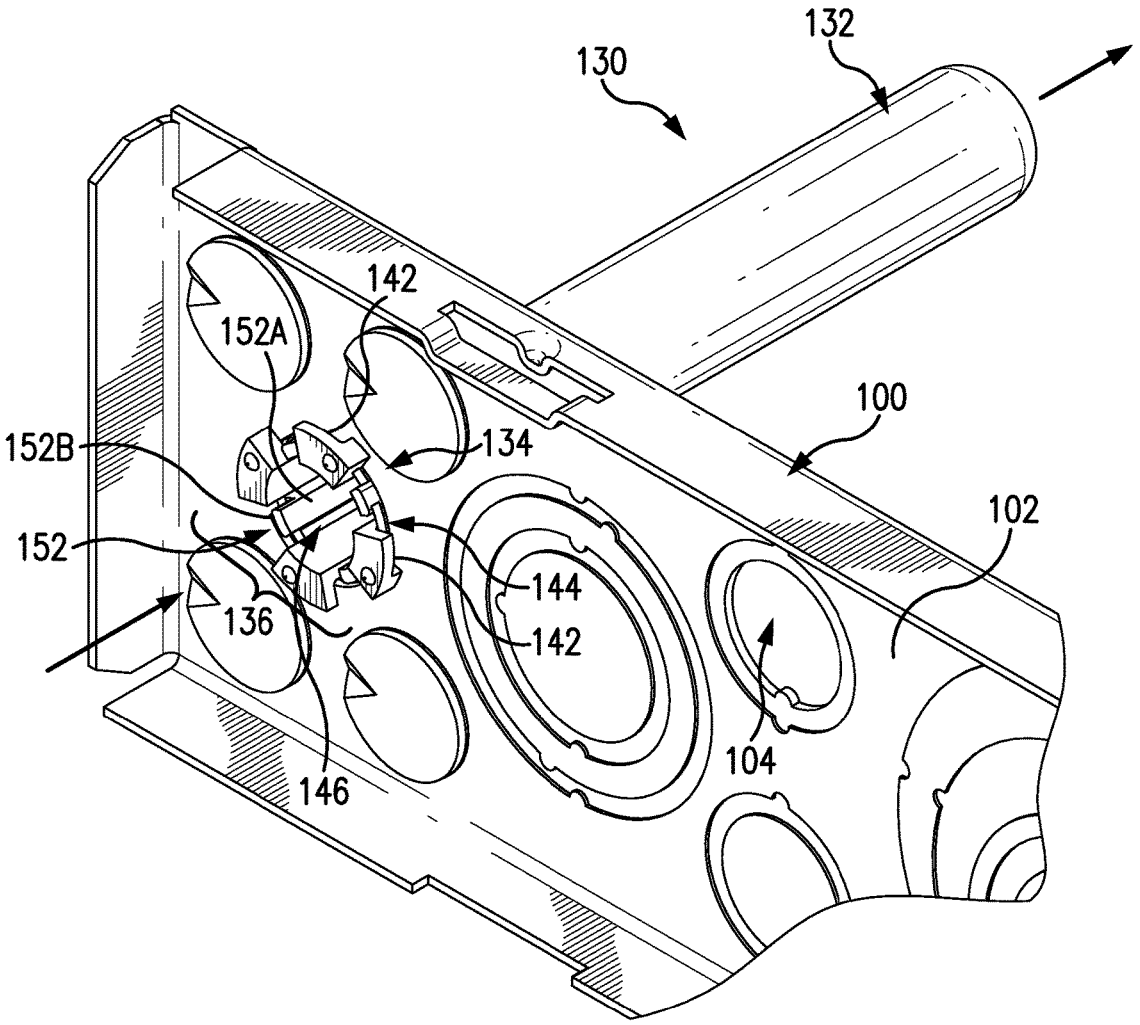
FIG. 3 illustrates the antenna cover of FIG. 2 engaged in the hole of the wall of the enclosure for an electrical panel.

As shown in FIGS. 2 and 3, the second end portion 134 of the antenna cover 130 includes an opening 146 through which to insert or remove an antenna from a cavity in the antenna cover 130. The second end portion 134 also includes a mounting assembly 136. In this example, the mounting assembly 136 is a snap-in mounting assembly that includes a flange 140 and a plurality of flexible flaring arms 150 adjacent to the flange 140. The plurality of flexible flaring arms 150 are spaced-apart along a circumference of the second end portion 134. The flange 140 includes one or more grooves 142 and slots 144. The flexible flaring arms 150 are formed of a flexible or resilient dielectric material. Each of the flexible flaring arms 150 is configured to deflect to allow passage through the hole 104 of the wall 102 of the electrical enclosure 100 as the antenna cover 130 is inserted through the hole 104. The flexible flaring arms 150 then expand and snap outward as a portion of each of the flexible flaring arms 150 exits the hole to apply a clamping force together with the flange 140 to retain the antenna cover 130 on the enclosure 100 at a mounted position (as shown in FIG. 3).

The flexible flaring arm 150 includes an end 152, arranged adjacent or in proximity to the flange 140. The end 152 is configured to contact and apply a force against a surface of the wall 102 in a hole 104 and against the exterior wall of the enclosure 100 around the hole 104, when the mounting assembly 136 is snapped in the hole 104. In this example, the end 152 has a step- or L-shape, with a surface of one portion 152A configured to contact the exterior of the wall 102 around the hole 104 and a surface of another portion 152B configured to contact a surface of the wall 102 in the hole 104. The portion 152A has a cross-sectional dimension greater than the portion 152B, which extends therefrom. The portion 152B can be used to deflect the flaring arm in order to remove the antenna cover 130 from the hole 140. For example, each pair of flexible flaring arms 150 may differ as to length (e.g., length of the flexible flaring arm 150 or the length of the portion 152B), to allow it to work with enclosures of different thicknesses.

Figure 5:
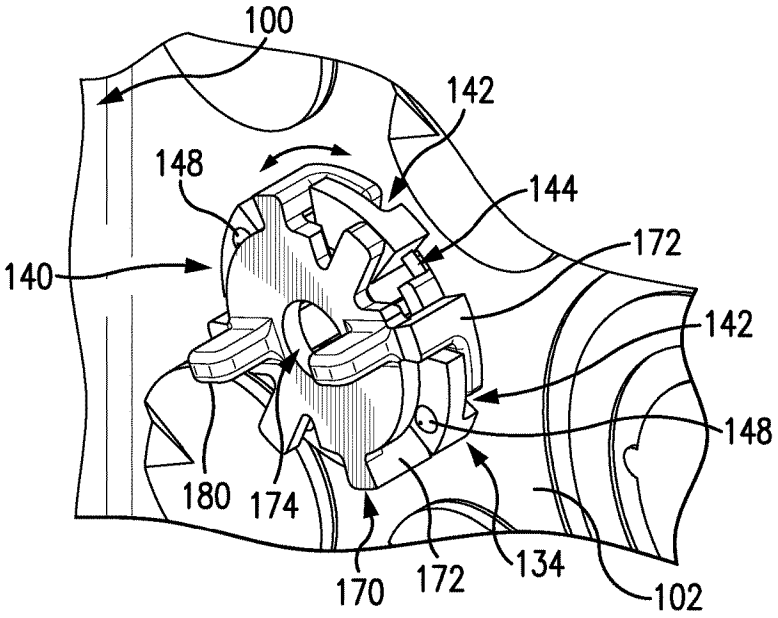
FIGS. 4, 5 and 6 illustrate different views of a retainer of the antenna mount of FIG. 1, which can be engaged to or disengaged from the antenna cover.
Figure 4:
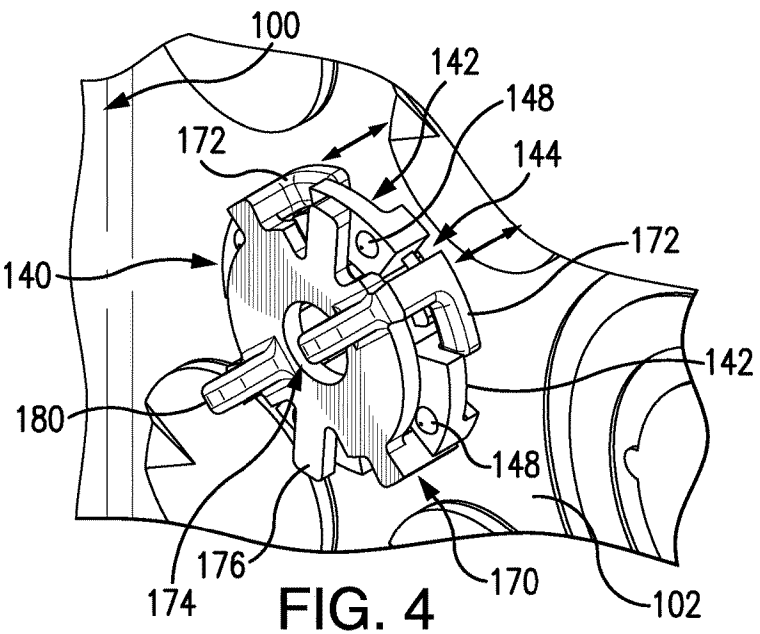

As shown in FIG. 4, the retainer 170 includes a plurality of circumferential arms 172, an aperture 174 and a handle 180 for a user to hold and manipulate the retainer 170. The circumferential arms 172 are configured to extend through a corresponding slot 144 of the flange 140 of the antenna cover 130 in an unlocked position as shown in FIG. 4. The circumferential arms 172 can then be rotated as shown in FIG. 5 to engage corresponding grooves 142 of the flange 140 of the antenna cover 130 to move the retainer 170 toward a locked position to secure the retainer 170 onto the flange 140 of the antenna cover 130.

Figure 6:
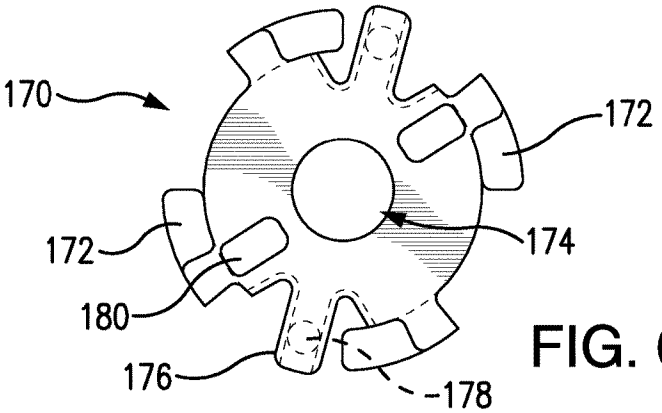

To more securely hold the retainer 170 and the flange 140 of the antenna cover 130 together in the locked position, the flange 140 of the antenna cover 130 can include protrusions which are configured to engage corresponding depressions on the retainer 170, or vice-a-versa, when in the locked position. For example, the flange 140 can include protrusions 148 (shown in FIGS. 4 and 5) which engage corresponding depressions 178 on arms or extensions 176 of the retainer 170 (shown in a top view of the retainer 170 in FIG. 6). Accordingly, force must be applied to disengage the protrusions 148 from the depressions 178 in order to move the retainer 170 from the locked position to the unlocked position. The number, size and shape of the protrusions and the depressions can be configured to withstand forces generated by electrical devices in the electrical enclosure, or the surrounding environment.

Figure 7:
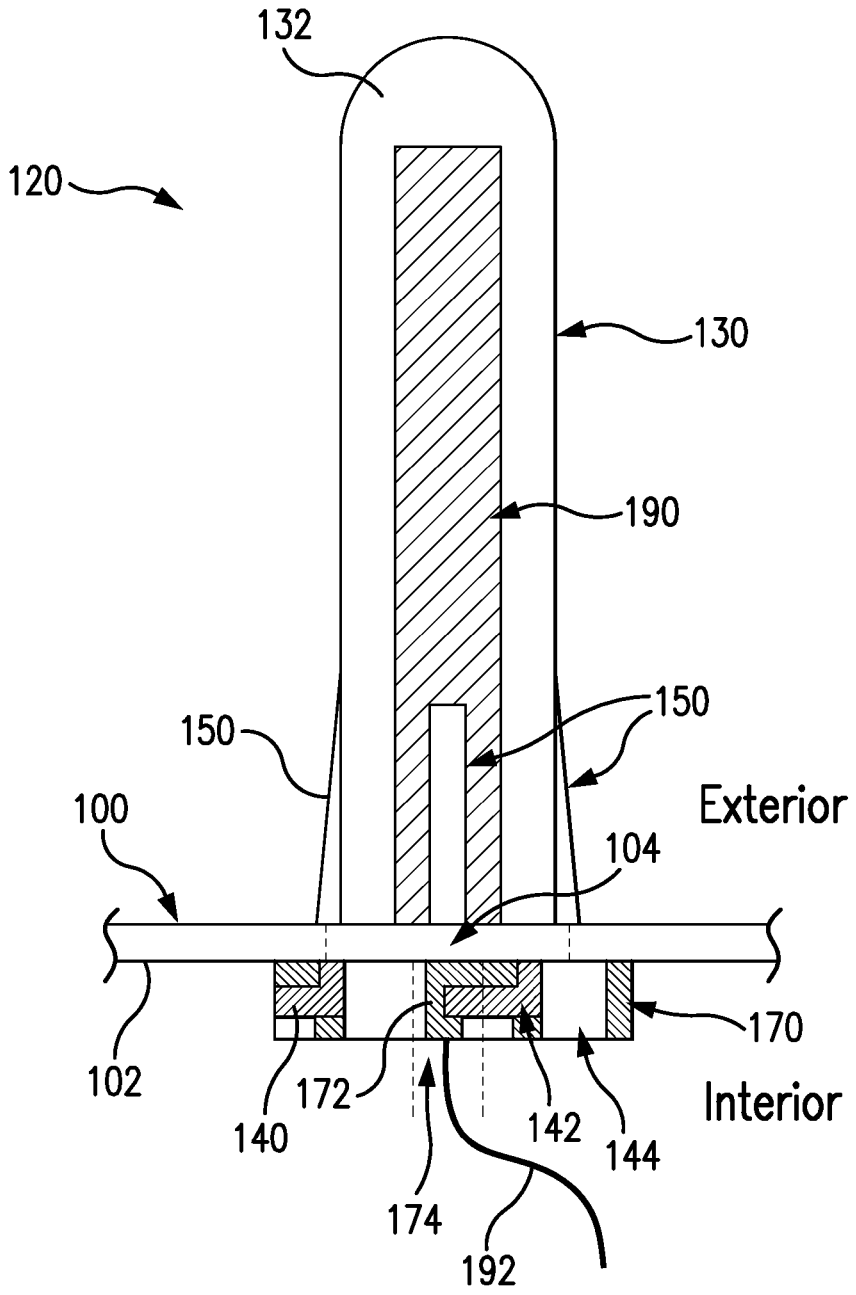
FIG. 7 illustrates the antenna mount of FIG. 1A mounted onto a wall of an enclosure for an electrical panel.

FIG. 7 illustrates the antenna mount 120 mounted through the hole 104 onto the wall 102 of the electrical enclosure 100 between the flange 140 and the flexible flaring arms 150. As further shown, the retainer 170 is engaged to the flange 140 of the antenna cover 130 in the locked position, with the circumferential arms 172 engaged to corresponding grooves 142 (also shown in FIGS. 4 and 5) of the flange 140. In the locked position, the retainer 170 closes the opening 146 (not shown) of the antenna cover 130 and retains an antenna 190 in the antenna cover 130. For example, the antenna 190 is housed and retained in the antenna mount 120, and a cable 192 of the antenna 190 extends through the aperture 174 (shown generally by the dotted lines) of the retainer 170.

In this example, the antenna cover 130 is mountable from an inside of the electrical enclosure 100. For example, the first end portion 132 is inserted through one of the holes 104 in the wall 102 of the electrical enclosure 100 from an interior to an exterior of the enclosure to mount the antenna cover 130 onto the wall of the enclosure, such as shown in FIG. 3. An antenna (e.g., antenna 190 of FIG. 7) is inserted into the antenna cover 130 through the opening (e.g., the opening 146 in FIG. 3). The retainer 170 is engaged to the flange 140 of the antenna cover 130 by inserting the circumferential arms 172 through corresponding slots 144 (in FIG. 4) and then rotating the circumferential arms 172 to engage corresponding grooves of the flange 140 (in FIG. 5) until the retainer 170 is placed in the locked position to retain the antenna in the antenna cover 130 (in FIG. 7).

Figure 8:
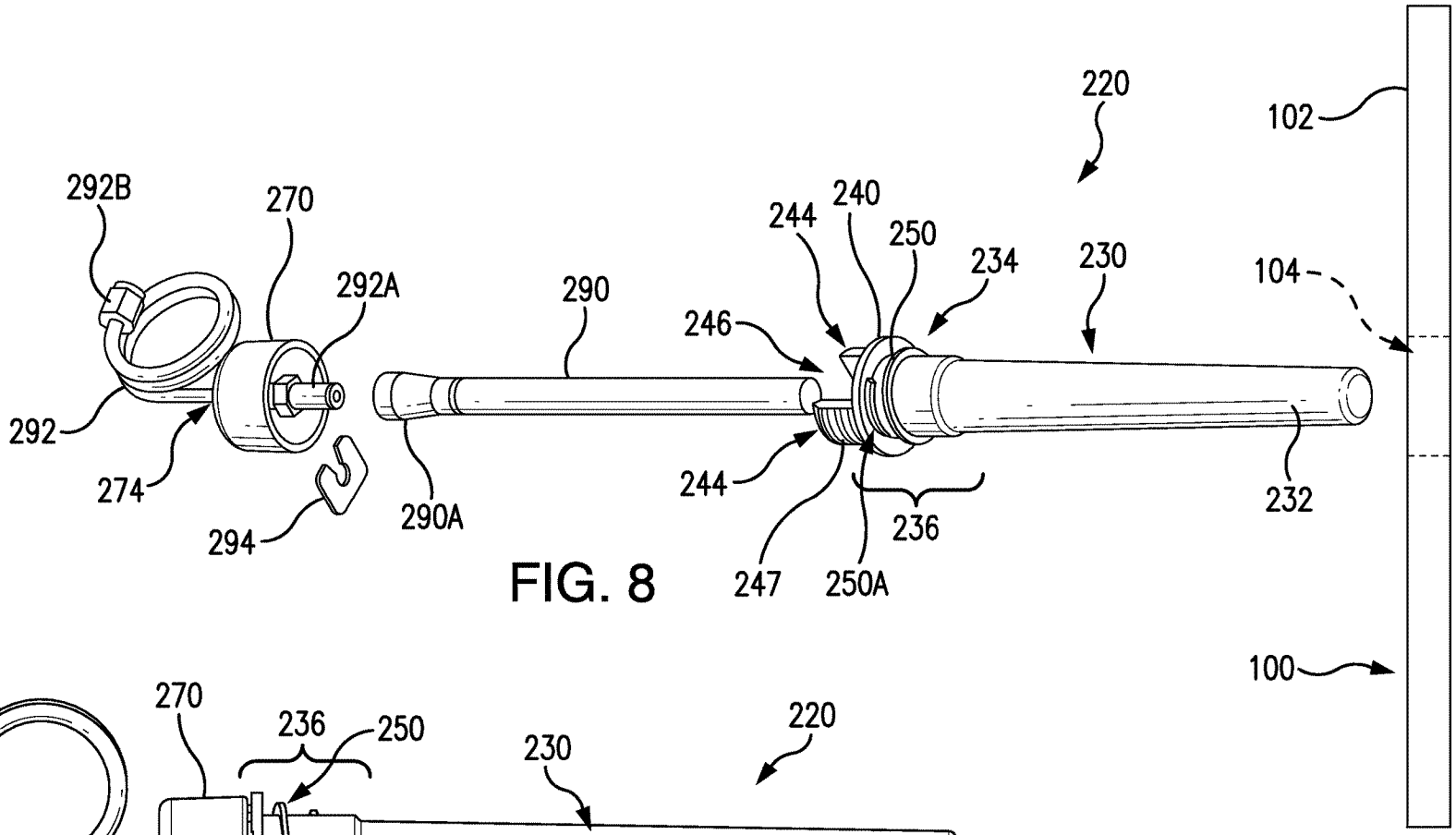
FIG. 8 illustrates a view of an antenna mount along with an antenna to be retained therein, in accordance with a second embodiment of the present disclosure.
Figure 9:
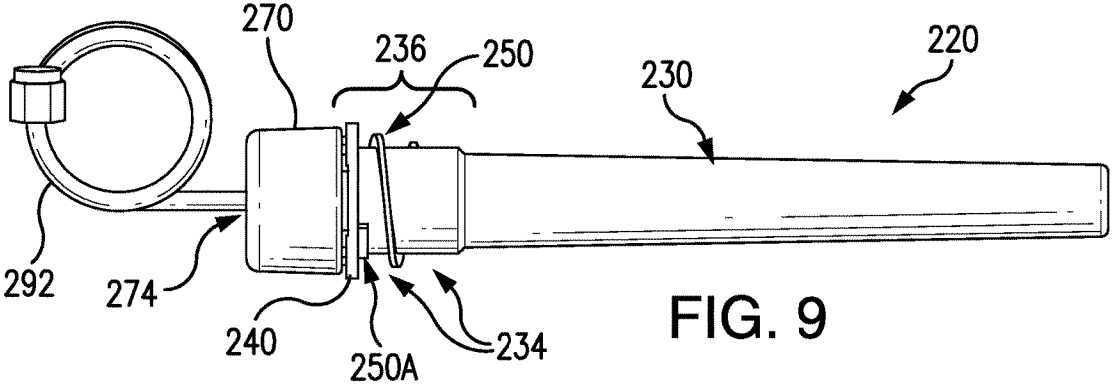
FIG. 9 illustrates another view of the antenna mount of FIG. 8 with the antenna retained therein.

FIGS. 8 and 9 illustrate an antenna mount 220, which is mountable onto a wall 102 of an electrical enclosure 100, in accordance with a second embodiment of the present disclosure. As shown in FIG. 8, the antenna mount 220 includes an antenna cover 230 and a retainer 270. The antenna cover 230 includes first end portion 232 and second end portion 234 opposite the first end portion 232. The first end portion 232 (also referred to as an "insertion end") is configured to be inserted through the hole 104 from an interior to an exterior of the electrical enclosure 100 to mount the second end portion 234 of the antenna cover 230 onto the wall 102 of the electrical enclosure 100. For example, the antenna cover 230 has a size and shape (e.g., a diameter) which allow the antenna cover to be inserted through the hole 104.

The second end portion 234 of the antenna cover 230 includes an opening 246 through which to insert or remove an antenna 290 from a cavity in the antenna cover 230, and one or more cantilever legs 244 having a plurality of ribs 247 to engage an interior surface of the retainer 270. The second end portion 234 also includes a mounting assembly 236 for mounting the antenna cover 230 in the hole 104 of the wall 102. The mounting assembly 236 is a screw-on mounting assembly that includes a flange 240 and threaded portion (e.g., threads) 250 adjacent to the flange 240. The threaded portion 250 and the threads thereon can be formed through a molding process (e.g., molded threads), and can have a thread spacing, which is configured according to the thickness of the wall (e.g., 16 gauge, 14 gauge, 12 gauge, etc.) and the dimension of the hole in the wall.

To mount the antenna cover 230 onto the wall 102, the first end portion 232 of the antenna cover 230 is inserted through the hole 104 of the wall 102. The threaded portion 250 of the antenna cover 230 is then screwed into the hole 104 until the flange 250 abuts, contacts or is adjacent (e.g., in contact, near or in proximity) a surface of the wall 102 (e.g., an interior of the wall 102 or interior wall) around the hole 104. The threaded portion 250 can include a threaded sub-portion 250A (e.g., a sub-portion of thread(s)), which straightens out the flange 240 of the antenna cover 230 as the threaded portion 250 is screwed into the hole 104 so the flange 240 is flush against the wall 102 (rather than angled), when the antenna cover 230 is mounted in the hole 104 of the wall 102 at the mounted position. Accordingly, the antenna cover 230 may seal the hole 104 of the electrical enclosure 100 when the antenna cover 230 is mounted onto the enclosure 100. The antenna cover 230 thus may be particularly useful for outdoor applications where the electrical enclosure is located outside of a building.

The retainer 270 may include an aperture 274 to allow an antenna cable 292 to extend therethrough, similar to the aperture 174 in the retainer 170 of FIG. 4. In this example, the retainer 270 has at least a portion of the antenna cable 292 (e.g., a coaxial cable) pre-assembled thereon so the antenna cable 292 extends therethrough. The antenna cable 292 includes one end with a first connector 292A to connect with a corresponding connector 290A of the antenna 290, and another end with a second connector 292B for connecting to another cable connected to wireless radio circuitry of a wireless communication module or system. A clip 294 can be used to further secure the antenna connector 290A and cable first connector 292A together. The connectors 290A, 292A and 292B can be male or female-type cable connectors, which can be snapped or screwed into or onto another cable connector. In this example, the connector 290A is a female-type connector, and the connector 292A is a male-type connector. The retainer 270 may be a cap or a boot, which can be made of a dielectric material, plastic or vinyl. The antenna 290 can be connected to the antenna cable 292, and inserted into a cavity of the antenna cover 230 through the opening 246. The retainer 270 can then be engaged and secured onto the second end portion 234 of the antenna cover 230, via the cantilever leg(s) 244 and their ribs 247 which engage an interior surface of the retainer 270. The retainer 270 covers the opening 246 of the antenna cover 230, and retains the antenna 290 in a cavity of the antenna cover 230, such as shown in FIG. 9.

Figure 10:
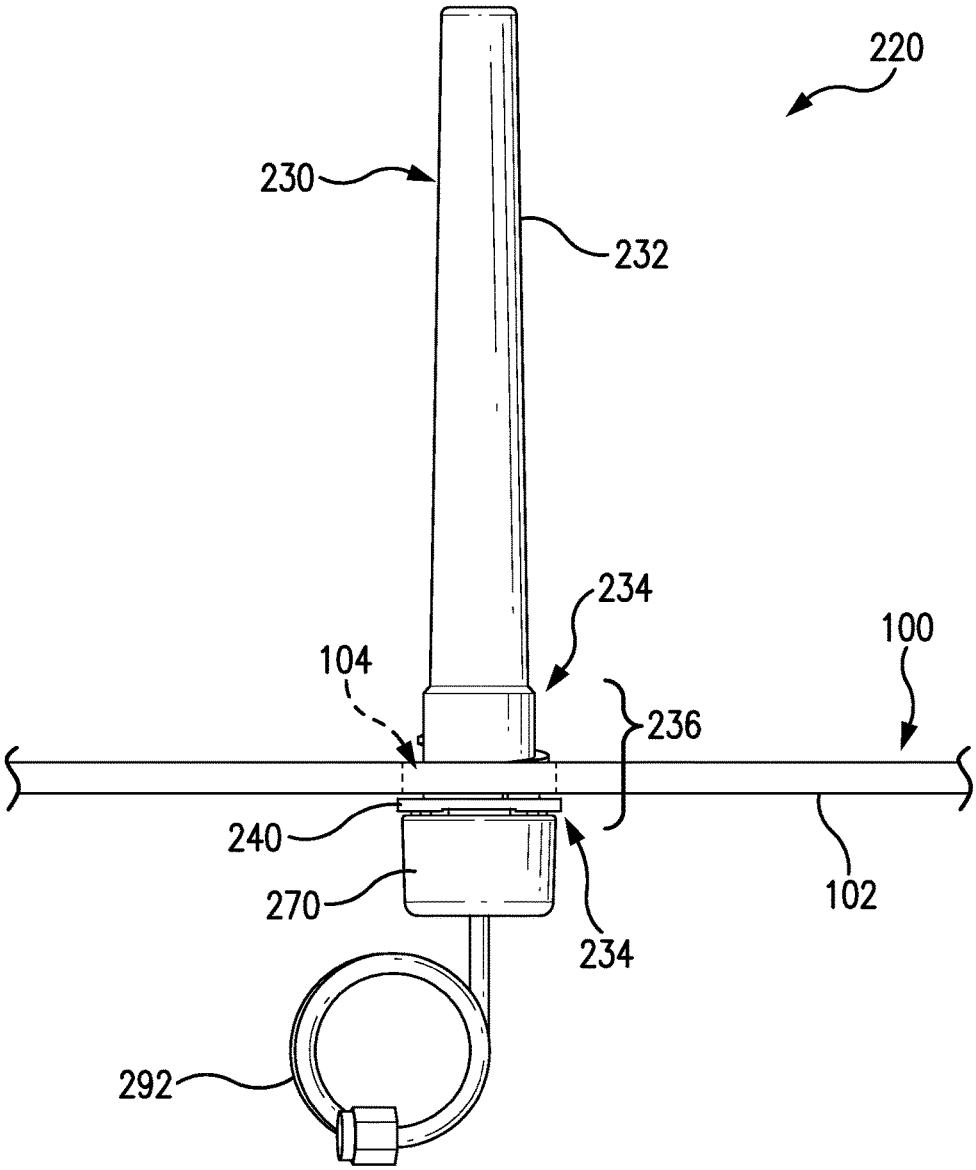
FIG. 10 illustrates a further view of the antenna mount of FIG. 8 mounted onto a wall of an enclosure for an electrical panel.

In FIG. 10, the antenna mount 220 is mounted on the wall 102 of the electrical enclosure 100. As shown, the retainer 270 is securely connected to the antenna cover 230 in a locked position, which closes the opening 246 (not shown) of the antenna cover 230 and retains the antenna 290 (not shown) inside the antenna cover 230 with the antenna cable 292 extending out from the retainer 270.

The disclosed embodiments of the antenna mount are simply provided as examples. The size and shape of an antenna cover of an antenna mount can be changed to fit antennas of different sizes and shapes than those described and shown in the present disclosure. The antenna mount or components thereof can be formed of a dielectric material, plastic or any suitable material depending on the application. Each of the components or sub-components of the antenna mount, such as for example the antenna cover, the mounting assembly, the threaded portion and the retainer, can be molded components. The retainer may also be engaged to an end portion of the antenna cover, using various fastening arrangements such as a screw-on assembly with threads or a snap-in assembly with resilient elements.

It will be appreciated by the person having ordinary skill in the art that in some instances antenna mounts according to the present invention might be mounted from the exterior of the load center enclosure. For example, the antenna mount of FIG. 1A can be modified with a flexible or resilient flange. Further the antenna might be mounted within the cover prior to or after placement of the antenna mount on the wall of the enclosure.

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the invention as defined in the appended claims.

The invention claimed is:

1. An antenna mount for an enclosure of a panelboard comprising:

an antenna cover mountable on the enclosure via a hole on a wall of the enclosure, the antenna cover having:

an opening at one end portion through which to insert an antenna into the antenna cover, and a mounting assembly to mount the one end portion of the antenna cover onto the wall of the enclosure via the hole, the mounting assembly including a flange configured to abut against or to be adjacent a wall of the enclosure around the hole when the antenna cover is arranged in the hole at a mounted position; and a retainer configured to engage the antenna cover to close the opening and retain the antenna inserted into the antenna cover through the opening within the antenna cover which provides a protective barrier around the antenna, wherein the antenna cover, when mounted onto the wall, allows receipt of the antenna therein or removal of the antenna therefrom through the opening at the one end, when the retainer is disengaged from the antenna cover.

2. The antenna mount of claim 1, wherein the antenna cover includes an insertion end that is opposite to the one end portion having the mounting assembly, the insertion end being configured to be inserted through the hole from an interior to an exterior of the enclosure to mount the antenna cover onto the wall of the enclosure.

3. The antenna mount of claim 1, wherein the mounting assembly is a snap-in mounting assembly which further includes a flexible flaring arm adjacent to the flange of the antenna cover, the flexible flaring arm configured to deflect to allow passage through the hole as the antenna cover is inserted through the hole and to expand and snap outward as a portion of the flexible flaring arm exits the hole to apply a clamping force together with the flange to retain the antenna cover on the enclosure at the mounted position.

4. The antenna mount of claim 3, wherein the flexible flaring arm includes an end arranged adjacent to the flange, the end of the flaring arm being configured to contact and apply a force against a surface of the wall in the hole and against the exterior wall of the enclosure around the hole.

5. The antenna mount of claim 3, wherein the flexible flaring arm comprises a plurality of flexible flaring arms spaced-apart along a circumference of the one end portion of the antenna cover.

6. The antenna mount of claim 3, wherein the flange includes a slot and a groove and the retainer includes a circumferential arm which is configured to extend through the slot and to rotatably engage the groove to secure the retainer onto the flange of the antenna cover.

7. The antenna mount of claim 3, wherein the flange includes a plurality of slots and grooves and the retainer includes a plurality of circumferential arms which are configured to extend through a corresponding slot from the plurality of slots and to rotatably engage a corresponding groove from the plurality of grooves to secure the retainer onto the flange of the antenna cover.

8. The antenna mount of claim 1, wherein the mounting assembly is a screw-on mounting assembly which further includes a threaded portion adjacent to the flange on the antenna cover, the threaded portion configured to screw into the hole of the enclosure until the flange abuts or is proximate the interior wall around the hole at the mounted position.

9. The antenna mount of claim 8, wherein the one end portion of the antenna cover further includes two flexible cantilever legs configured to engage the retainer.

10. The antenna mount of claim 1, wherein the antenna cover is formed of a dielectric material or plastic.

11. The antenna mount of claim 1, wherein the antenna cover seals the hole of the enclosure when the antenna cover is mounted onto the enclosure at a mounted position.

12. The antenna mount of claim 1, wherein the retainer includes an aperture configured to allow a cable connected or connectable to the antenna to extend therethrough into the interior of the enclosure.

13. The antenna mount of claim 1, wherein the opening is the only opening in the antenna cover, which includes a cavity for receiving the antenna therein.

14. The antenna mount of claim 1, wherein the retainer extends across the opening to cover the opening when the retainer is engaged to the antenna cover.

15. The antenna mount of claim 1, wherein the retainer comprises a cap or boot.

16. A panelboard housing comprising:

an enclosure for a panelboard, the enclosure including a wall having a knockout;

an antenna cover mountable on the enclosure via a knockout hole on a wall of the enclosure, the antenna cover having:

an opening at one end portion through which to insert an antenna into the antenna cover, and a mounting assembly to mount the one end portion of the antenna cover onto the wall of the enclosure via the hole, the mounting assembly including a flange configured to abut against or to be adjacent a wall of the enclosure around the hole when the antenna cover is arranged in the hole at a mounted position; and a retainer configured to engage the antenna cover to close the opening and retain the antenna inserted into the antenna cover through the opening within the antenna cover which provides a protective barrier around the antenna, wherein the antenna cover, when mounted onto the wall, allows receipt of the antenna therein or removal of the antenna therefrom through the opening at the one end, when the retainer is disengaged from the antenna cover.

17. The panelboard housing of claim 16, wherein the antenna cover includes an insertion end that is opposite to the one end portion having the mounting assembly, the cover being of a diameter to be inserted through the hole from an interior to an exterior of the enclosure to place the mounting assembly of the antenna mount onto the wall of the enclosure.

18. The panelboard housing of claim 16, wherein the mounting assembly is a snap-in mounting assembly which further includes a flexible flaring arm adjacent to the flange of the antenna cover, the flexible flaring arm configured to deflect to allow passage through the hole as the antenna cover is inserted through the hole and to expand and snap outward as a portion of the flexible flaring arm exits the hole to apply a clamping force together with the flange to retain the antenna cover on the enclosure at the mounted position.

19. The panelboard housing of claim 16, wherein the mounting assembly is a screw-on mounting assembly which further includes a threaded portion adjacent to the flange on the antenna cover, the threaded portion configured to screw into the hole of the enclosure until the flange abuts or is proximate the interior wall around the hole at the mounted position.

* * * * *